United States Patent [19]

Chapelot

[11] Patent Number: 4,580,341

[45] Date of Patent: Apr. 8, 1986

[54] ELECTRICAL CONNECTOR

[75] Inventor: Raymond Chapelot, Lagny-sur-Marne, France

[73] Assignee: Precision Mecanique Labinal, Bois D'Arcy, France

[21] Appl. No.: 566,884

[22] Filed: Dec. 29, 1983

[30] Foreign Application Priority Data

Dec. 30, 1982 [FR] France ..... 82 22105

[51] Int. Cl.[4] ..... H01R 13/506

[52] U.S. Cl. ..... 29/874; 339/206 R; 339/217 S

[58] Field of Search ..... 339/217 S, 206 R, 206 P, 339/207 R, 207 S, 208, 209, 210 R, 210 M; 29/842, 857, 861, 863, 874

[56] References Cited

U.S. PATENT DOCUMENTS

| | | | |
|---|---|---|---|
| 3,399,374 | 8/1968 | Pauza | 339/91 |
| 3,648,213 | 3/1972 | Kobler | 339/217 S |
| 4,045,110 | 8/1977 | Sterken | 339/217 S |
| 4,090,770 | 5/1978 | McKee et al. | 339/206 R |
| 4,436,361 | 3/1984 | McCleerey | 339/206 R |

FOREIGN PATENT DOCUMENTS

| | | | |
|---|---|---|---|
| 1373539 | 11/1963 | France . | |
| 2262873 | 3/1974 | France . | |
| 2457023 | 1/1983 | France . | |
| 1584619 | 2/1981 | United Kingdom . | |
| 2071926 | 9/1981 | United Kingdom | 339/210 M |

*Primary Examiner*—John McQuade

*Attorney, Agent, or Firm*—Sandler & Greenblum

[57] ABSTRACT

An electrical connector includes an insulating housing having a first housing part which includes a plurality of substantially parallel compartments each for receiving a first electrical contact element having a first portion for making electrical contact with a second electrical contact element and a second portion for connection to an electrical conductor. The compartments have a length such that the second portions of the first contact elements project out one end of the compartments. The insulating housing includes a second housing part for slidably receiving the first housing part. A securing member secures the first and second housing parts with respect to each other in a first preliminary locking position in which the second housing part shields the second portions of the first contact elements, a second position in which the second portions are disengaged to enable them to be connected to electrical conductors, and a third final locking position in which the second portions are shielded by the second housing part.

9 Claims, 16 Drawing Figures

ELECTRICAL CONNECTOR

FIELD OF THE INVENTION

The present invention relates to electrical connection devices.

BACKGROUND OF THE INVENTION

An object of the invention is to provide an improved electrical connector of the type which includes an insulating box or housing having compartments each designed to accommodate an electrical contact element of which one and is intended to be connected to a corresponding contact element and the other to an electrical conductor. In general, the corresponding contact element is contained in another box or housing designed to be connected to the first box.

Numerous connectors of the above type are already known. The procedure for mounting them is generally as follows. The contact elements, which usually consist of male or female sockets, are supplied in bulk or strip form. The insulating boxes in which the contact elements are to be housed are usually supplied separately. The electrical conductors are clamped, soldered or mounted by any suitable method on the sockets. The sockets are then inserted in corresponding compartments of the insulating boxes and locked therein. The sockets comprise locking or securing means enabling them to be secured in the compartments, or, alternatively, the compartments themselves include such locking means. Also alternatively, both components can have locking means which are complementary to each other.

In the course of the various manipulations involved in mounting the contacts within the housing, the locking devices for the sockets, the means for connecting the sockets to the electrical conductor and/or the sockets themselves are frequently damaged or deformed, thus posing a considerable number of disadvantages. Specifically, the sockets no longer provide satisfactory electrical connections, nor can they be secured in position in the insulating box. Also, the electrical conductors are not fixed to the contact members in a suitable manner, thus making it impossible to assemble the pieces automatically by machine. These various disadvantages are even more acute in the case of particularly small connectors which utilize extremely fragile sockets.

It is, therefore, an object of the present invention to provide an electrical connector which overcomes the abovedescribed deficiencies in the prior art.

SUMMARY OF THE INVENTION

According to the present invention, an electrical connector is provided which includes an insulating box having a plurality of substantially parallel compartments each adapted to receive a first electrical contact element having a first portion for making electrical contact with a second electrical contact element and a second portion for connection to an electrical conductor. The insulating box includes a first part including a plurality of compartments for receiving a respective plurality of first contact elements. The compartments have a length such that the second portion of a first electrical contact element projects out one end of the compartment in which it is received. The insulating box also includes a second part for slidably receiving the first part. Means are provided for securing the first part and the second part with respect to each other in a first preliminary locking position in which the second part shields the second portion of the first contact elements, a second position in which the second portion is unshielded by the second part to enable the second portion to be connected to an electrical conductor, and a third final locking position in which the second portion is shielded by the second part.

The connector can also include means for locking the first contact elements in the compartments. The means for locking can include a thrust bearing disposed at one end of a compartment against which one end of a contact element abuts, and a retaining tongue disposed on a contact element for abutting a steep edge of a wing member disposed adjacent the end of a compartment from which a second portion projects.

The first part can include a pair of opposed substantially parallel slide members and the second slide members and the second part can include a pair of opposed substantially parallel guide bars for engaging the slide members. The plurality of compartments can be separated from each other by slits and the second part can include a plurality of partitions for engaging the slits. Each compartment can include a lateral aperture adjacent the end from which the second portion projects, this end including a pair of substantially parallel wing members for engaging a retaining tongue of a first electrical contact member, each wing member having an edge for abutting a retaining tongue. The wing members can extend from the end of a compartment from which a second portion projects. The retaining tongue can engage the lateral aperture located adjacent a wing member. During assembly of the electrical contact element and the electrical connector an electrical contact element is introduced into each compartment and comes to rest against the thrust bearing and an edge of the retaining tongue of the electrical contact element is elastically deformed against the steep edge of the wing. The second part can include a plurality of first bosses, each first boss being disposed between a pair of adjacent partitions, each first boss being aligned with an edge of a wing member when the first part and the second part occupy the third final locking position.

The first part can include a surface which includes a pair of ramp members each having a steep side which includes a pair of ramp members each having a steep side which includes a notch, with the first part further including a thrust bearing having a steep side which faces the steep sides of the ramp members. The second part can include an elastic locking tongue each side of which includes a lug for slidably engaging a ramp member while the first part and the second part are sliding with respect to each other. The elastic locking tongue can further include a recess for fitting over the thrust bearing. The lugs, the steep sides of the ramps, the thrust bearing and the recess can be disposed relative to each other such that when the first and second parts slide relative to one another in a first direction, the lugs disengage from the ramp members and the elastic locking tongue moves by elastic deformation into position over the thrust bearing so that the first and second parts occupy the first preliminary locking position and such that when the first and second parts slide relative to one another in a second direction substantially opposite to the first direction, the elastic locking tongue disengages from the thrust bearing and comes to rest adjacent to the steep side of the thrust bearing, the lugs engage the notches of the ramp members so that the first and second parts occupy the third final locking position. The ramp members are preferably substantially parallel to each other. The first part can include two pairs of ramp members disposed on opposite sides of the first part and the second part can include two elastic locking tongues.

The second part can include a surface which includes a pair of substantially parallel ramp members each having a steep side which includes a notch, the second part further including a thrust bearing having a steep side which faces the steep sides of the ramp members. The first part can include an elastic locking tongue each side of which includes a lug for slidably engaging a ramp member while the first part and the second part are sliding with respect to each other. The elastic locking tongue can further include a recess for fitting over the thrust bearing. The lugs, the steep sides of the ramps, the thrust bearing and the recess can be disposed relative to each other such that when the first and second parts slide relative to one another in a first direction, the lugs disengage from the ramp members and the elastic locking tongue moves by elastic deformation into position over the thrust bearing so that the first and second parts occupy the first preliminary locking position and such that when the first and second parts slide relative to one another in a second direction substantially opposite to the first direction, the elastic locking tongue disengages from the thrust bearing and comes to rest adjacent to the steep side of the thrust bearing, the lugs engage the notches of the ramp members so that the first and second parts occupy the third final locking position. The ramp members are preferably substantially parallel to each other. The second part can include two pairs of ramp members disposed on opposite sides of the second part and the first part can include two elastic locking tongues.

The first part can include a second boss, with the second part including a counter-boss. The second boss and the counter-boss rest against each other when the first and second parts occupy the first preliminary locking position. The second boss can be elastically mounted relative to the counter-boss such that the first part and the second part can continue to slide in the aforementioned first direction to reach the second position. Alternatively, the counter-boss can be elastically mounted relative to the second boss such that the first part and the second part can continue to slide in the aforementioned first direction to reach the second position.

The elastic locking tongue can include a release claw. The release claw can be disposed on a free end of the elastic locking tongue.

Also according to the present invention, a method is provided for interconnecting first and second housing parts of an electrical connector, the first housing part including a plurality of compartments for receiving a respective plurality of first contact elements each having a first portion for making electrical contact with a second electrical contact element and a second portion for connection to an electrical conductor, the compartments having a length such that the second portion of a first electrical contact element projects out one end of a compartment. Such method includes connecting the first and second housing parts together in a first preliminary locking position such that the second housing part shields the second portion of the first contact elements, subsequently connecting the first and second housing parts relative to each other in a second position in which the second portion of the first contact elements is unshielded by the second housing part such that the second portion of the first contact elements can be connected to an electrical conductor, and subsequently connecting the first and second housing parts relative to each other in a third final locking position in which the aforementioned portion of the electrical contact elements is shielded by the second housing part.

Such method can also include slidably connecting the first and second housing parts to each other. The first and second housing parts can be connected together in the first preliminary locking position by sliding the first and second housing parts in a first direction relative to one another to a position at which a locking tongue disposed on the second housing part and having a recess on one end is disposed such that the recess fits over a thrust bearing mounted on the second housing part. While the first and second housing parts are being slid in the aforementioned first direction relative to one another, the locking tongue can be lifted elastically relative to the first housing part such that the recess is lifted over the thrust bearing. Alternatively, the first and second housing parts can be connected together in the first preliminary locking position by sliding the first and second housing parts in a first direction relative to one another to a position at which a locking tongue disposed on the first housing part and having a recess on one end is disposed such that the recess fits over a thrust bearing mounted on the first housing part; while the first and second housing parts are being slid in the aforementioned first direction relative to one another, the locking tongue can be lited elastically relative to the second housing part such that the recess is lifted over the thrust bearing. The locking tongue can be lifted by a ramp member which engages a lug disposed on the locking tongue such that when the lug is slid to an edge of the ramp member, the lifting action ends, the locking tongue descends and the recess fits over the thrust bearing.

The first and second housing parts can be connected relative to each other in the second position by elastically disengaging the first and second housing parts from the first preliminary locking position whereby the first and second housing parts can be moved relative to one another such that the second portion of an electrical contact element is unshielded by the second housing part. The first and second housing parts can be elastically disengaged by interaction between a boss disposed on the first housing part and a counter-boss disposed on the second housing part. Alternatively, the first and second housing parts can be elastically disengaged by interaction between a boss disposed on the second housing part and a counter-boss disposed on the first housing part.

The first and second housing parts can be connected together in the third final locking position by sliding the first and second housing parts relative to one another in a second direction which is opposite to the aforementioned first direction such that the recess in the locking tongue disengages the thrust bearing and comes to rest adjacent a steep side of the thrust bearing and the lug engages a notch formed in the ramp member.

The method of the present invention also includes releasing the first and second housing parts from the third final locking position by repositioning the recess in the locking tongue over the thrust bearing. Such repositioning can be accomplished by a release claw disposed on the end of the locking tongue.

The method of the present invention can further include locking the first contact elements in the compartments in the first housing part. A first electrical contact element can be locked in a compartment by positioning it such that one end thereof abuts a thrust bearing disposed at one end of a compartment, and a retaining tongue disposed on the contact member abuts a steep edge of a wing member disposed adjacent the end of a compartment from which the second portion of the electrical contact element projects.

The connector according to the invention is of the type comprising an insulating box having compartments for accommodating first electrical contact elements comprising a first portion for interacting with a second electrical contact element in order to provide a connection and a second portion for connection to an electrical conductor. The insulating box includes two parts, of which the first part includes a plurality of compartments each for receiving a first contact element. Means are provided for locking the first contact elements in position in the plurality of compartments. The compartments have a length such that the second portion of a first contact element for connection to an electrical conductor projects out of one end of a compartment. The second part of the insulating box receives the first part, while the first and second parts include, on the one hand, elements adapted to slidably engage with each other, and, on the other hand, means for securing the first and second parts in three distinct positions in relation to each other, i.e. a first preliminary locking position, in which the second part conceals the aforementioned second portion of a first contact element for connection to an electrical conductor, a second position, in which the second portion of a first contact element for connection to an electrical conductor is disengaged such that it can be fixed in position with an electrical conductor, and, finally, a third final locking position, in which the second portion of each first contact element for connection to a respective electrical conductor is concealed or shielded by the second part of the insulating box.

This invention enables the sockets to be immediately mounted in the plurality of compartments, and also enables the first and second parts of the insulating box to be placed in the preliminary locking position at the actual manufacturing stage, so that the assemblies can be marketed and delivered in this form. This prevents the sockets from suffering damage in the course of transport or storage. At the point when the electrical equipment is being assembled to the contacts mounted in the insulating box, the first and second parts of the insulating box are positioned in the aforementioned second position to enable the sockets to be connected to electrical conductors. The insulating box is then positioned in the third final locking position, in which the electrical connections between the conductors and the respective sockets are properly protected by the second part of the insulating box.

According to one particular aspect of the present invention, the first part of the insulating box has a slide along each of two parallel opposite sides, with guide bars for these slides being provided along the two corresponding opposite sides of the second part of the box.

The plurality of compartments of the first part are preferably separated from each other by slits, the second part of the insulating box having partitions for engaging the slits in the first part. Each contact element, along with the conductor to which it is connected, will thus be completely insulated from the other contact elements when the first and second parts of the insulating box occupy the third final locking position.

According to another particular aspect of the present invention, each compartment includes a lateral aperture near the end thereof at which the second portion of the first contact element for connection to an electrical conductor emerges from the conductor. Such end of each compartment includes a pair of parallel wings. Each first contact element includes a retaining tongue for engaging the lateral space adjacent a wing by elastic deformation and for resting against an edge of a wing.

According to a further aspect of the present invention, the second part of the insulating box includes a plurality of first bosses each disposed between each pair of adjacent partitions, each first boss being aligned with an edge of a wing when the two parts of the insulating box occupy their third final locking position. This eliminates all risk of accidental displacement of a contact element in its compartment as a result of immobilization of its retaining clamps.

According to yet another aspect of the present invention, either the first or second part of the insulating box includes a pair of preferably parallel ramps each having a steep side which includes a notch, the first or second part also including a thrust bearing having a steep side which faces the steep sides of the ramps. The other part of the insulating box, i.e., the first or second part which does not include the aforementioned pair of parallel ramps or thrust bearing, includes an elastic locking tongue each side of which includes a lug for slidably engaging with a ramp during the sliding movement of the first and second parts. The elastic locking tongue also includes a recess for fitting over the thrust bearing. The positions of the lugs, the steep sides of the ramps, the thrust bearing and the recess are such that when the first and second parts slide in relation to each other in a first direction, the lugs disengage from the ramps and the elastic locking tongue moves by elastic deformation into position over the thrust bearing so that the first and second parts of the insulating box occupy the first preliminary locking position and such that when the first and second parts of the insulating box slide in relation to each other in a second direction, substantially opposite to the aforementioned first direction, the elastic locking tongue disengages from the thrust bearing and comes to rest against the steep side of the thrust bearing. The third final locking position is effected by the lugs engaging the notches of the pair of parallel ramps.

The first and second parts of the insulating box preferably comprise a second boss and a counter-boss, respectively, which come to rest against each other when the first and second parts occupy the first preliminary locking position, with either the second boss or the counter-boss being mounted elastically such that the first and second parts of the insulating box can continue to slide in the aforementioned second position. These features of the present invention make it possible to ensure locking action in the first of the three positions.

Finally, the elastic tongue preferably at its free end can include a release claw for manually releasing the first and second parts of the insulating box if necessary.

An electrical connector according to the present invention enables a very simple method of assembly particularly suited to mechanized production.

BRIEF DESCRIPTION OF THE DRAWINGS

The present invention will now be explained in greater detail by reference to one particular embodiment described solely by way of an example and illustrated in the accompanying drawings, wherein.

DETAILED DESCRIPTION OF THE INVENTION

Figure 1:
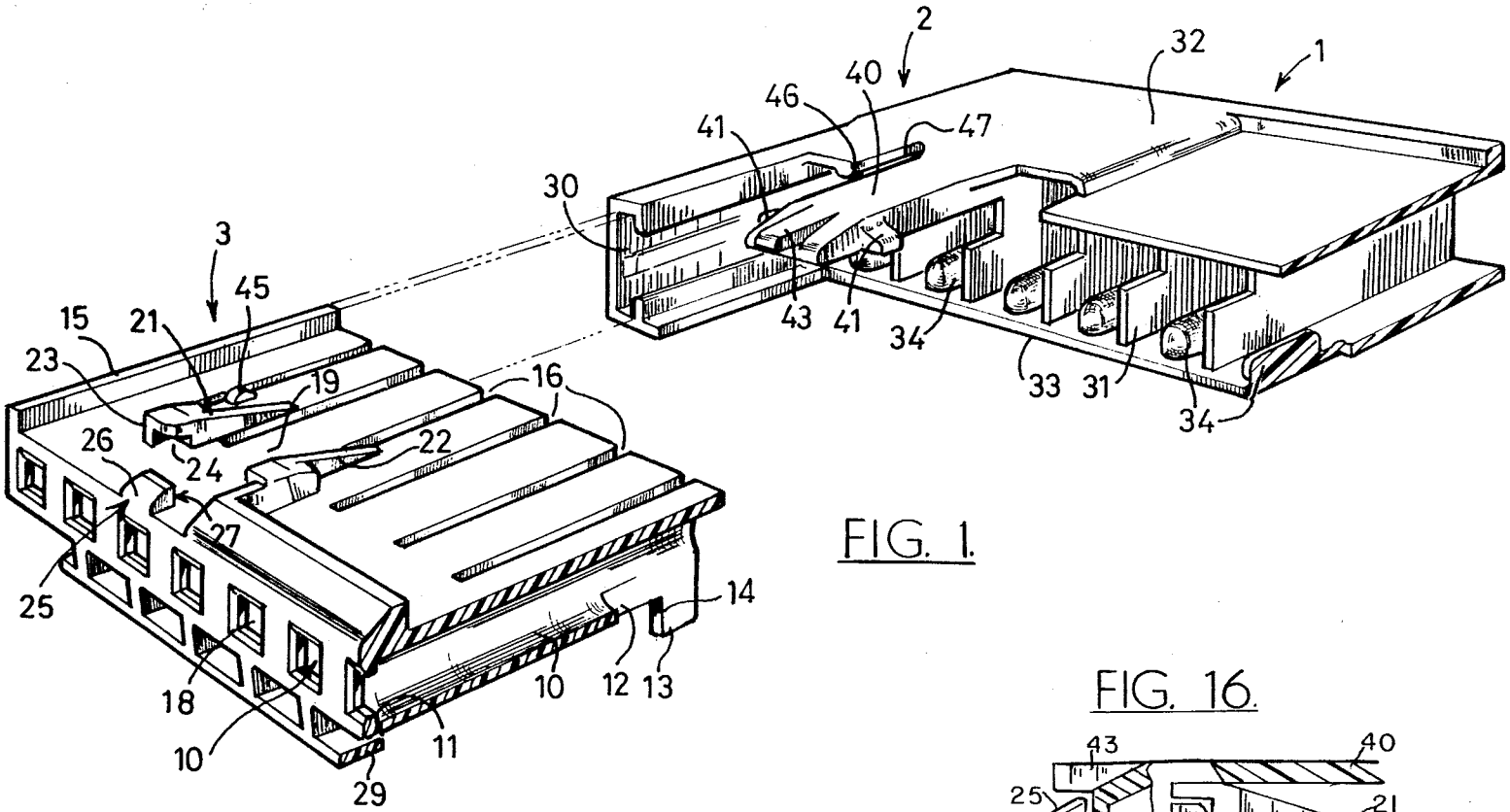
FIG. 1 is an exploded view, in perspective, of a connector according to the present invention.

The electrical connector illustrated in the various figures comprises an insulating box or housing designated by reference numeral 1 as a whole and including first and second housing parts 2 and 3.

In the embodiment described and illustrated in the figures, box 1 accommodates female electrical contact elements 4, but elements 4 could equally well be male sockets for ultimate connection with female contact members.

In the embodiment shown, contact elements 4 each include a tubular part 5, formed by a cylinder rolled from a strip of highly conductive metal, retaining tongues 6, and clamps 7 and 8 for clamping, respectively, a bare electrical conductor and its sheath.

First part 3 of insulating box 1 comprises a series of substantially parallel compartments 10 each for receiving or accommodating an electrical contact element 4. Each compartment 10 has at one a thrust bearing 11 which has a hole 18 and against which the free end of tubular part 5 comes to rest. The other end of each compartment 10 has a lateral aperture 12 with two substantially parallel wings 13. The sides of wings 13 which face thrust bearing 11 include steep edges 14.

During assembly, a contact element 4 is introduced into each compartment 10 and comes to rest against thrust bearing 11. A corresponding edge of retaining tongues 6 of contact element 4 comes to rest, by elastic deformation, against steep edges 14 of wings 13. Contact elements 4 are thus locked or secured in position and cannot accidentally disengage from their respective compartments 10.

First part 3 includes, along two opposite lateral sides, slides 15. Compartments 10 are separated from one another by slits 16. First part 3 includes, on its upper surface 19, two assemblies indicated by reference numeral 20, each comprising a pair of inclined ramps 21 and 22, each inclined ramp 21 and 22 terminating in a steep perpendicular side 23 containing a noch 24.

A free or open space is provided between ramps 21 and 22 of each ramp assembly 20. Thrust bearing 25 is disposed along the edge of first part 3 which is adjacent to thrust bearing 11 and to surface 19. Thrust bearing 25 is aligned with the aforementioned free space and includes a steep perpendicular side 27 which faces perpendicular sides 23 of ramps 21 and 22. Thrust bearing 25 has an inclined portion 26 on a side which is opposite to perpendicular side 27. First part 3 includes stop bar 29 on a side opposite to surface 19 near thrust bearing 11.

Second part 2 of insulating box 1 includes, along two opposite sides, guide bars 30 for receiving slides 15 of first part 3 such that first housing part 3 can slidably engage second housing part 2. A series of partitions 31 are disposed between guide bars 30, each partition 31 corresponding to a slit 16. Partitions 31 extend into or engage a corresponding slit 16.

Partitions 31 are disposed between upper wall 32 and lower wall 33 of second part 2. Lower wall 33 includes a series of first bosses 34, located between a pair of adjacent partitions 31. During assembly, first bosses 34 come to rest in front of a pair of wings 13 of a compartment 10 and on a line generally parallel to and extending between wings 13, to lock retaining tongues 6 against edges 14 of wings 13.

Upper wall 32 includes a pair of elastic tongues 40, each having a pair of side lugs 41 for entering or engaging notches 24 of ramps 21 and 22. It should be noted that each tongue 40 engages a separate ramp pair 21, 22 located on opposite sides of upper surface 19 of first housing part 3. Each tongue 40 includes a recess 42 and terminates in a clamp 43 on its side corresponding to surface 19 of first part 3.

A second boss 45 is located on surface 19 of first part 3 in the vicinity of each slide 15. Counter-bosses 46 are positioned on the lower surface of upper wall 32 of second part 3. A slit 47 is disposed along each locking tongue 40 near counter-bosses 46 to give upper wall 32 a degree of flexibility to enable counter-bosses 46 to pass above second bosses 45 during a particular part of the assembly process as explained in detail below.

Contact elements 4 are each received or accommodated in a housing or compartment 10, while the edges of retaining tongues 6 cooperate with edges 14 of wings 13.

Figure 2:
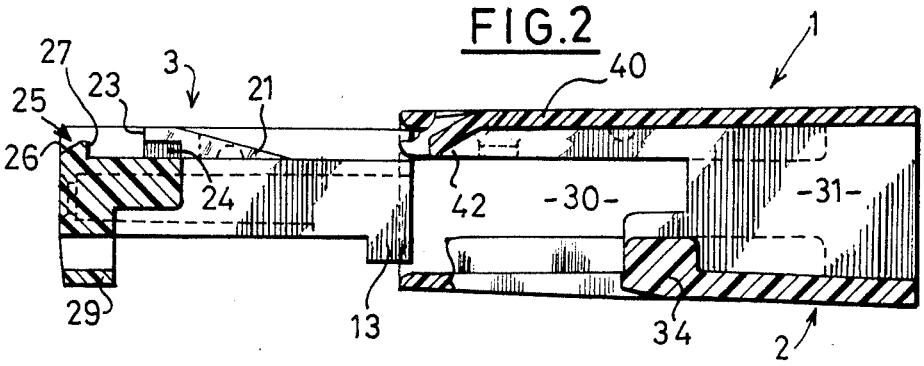
FIG. 2 is a sectional view along line II—II of FIG. 3.
Figure 3:
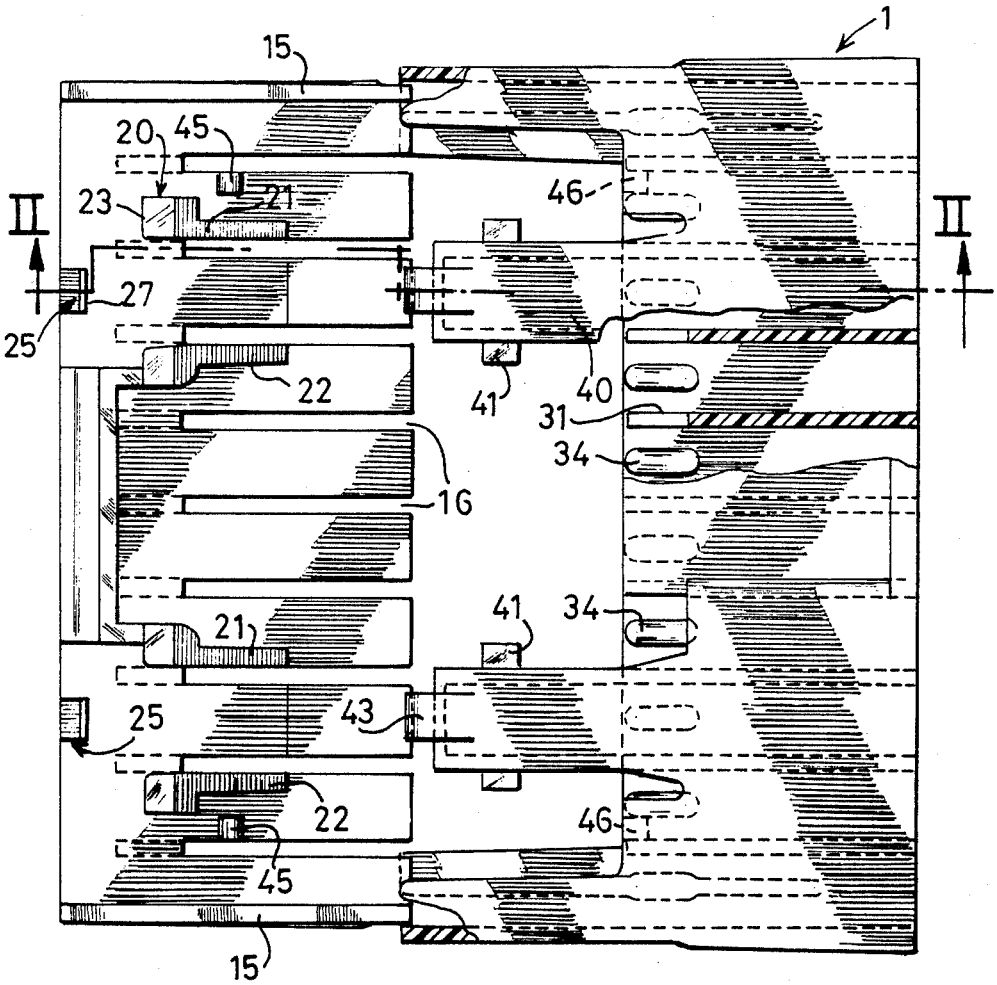
FIG. 3 is a plan view of a connector according to the present invention.
Figure 4:
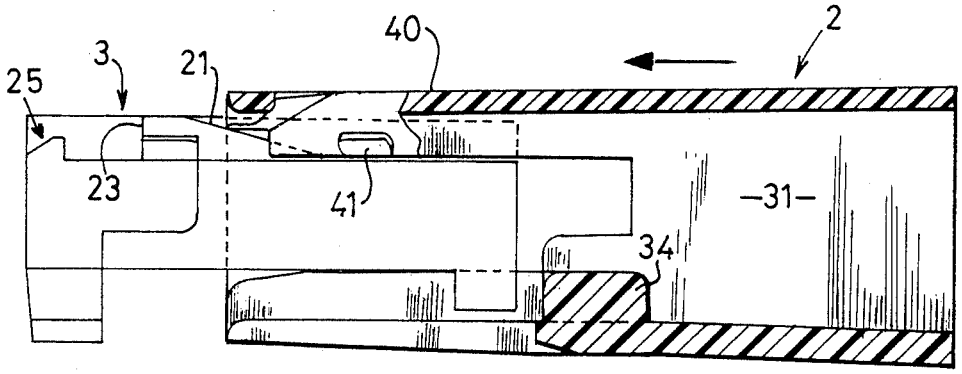
FIG. 4 is a sectional view along line IV—IV of FIG. 5.
Figure 5:
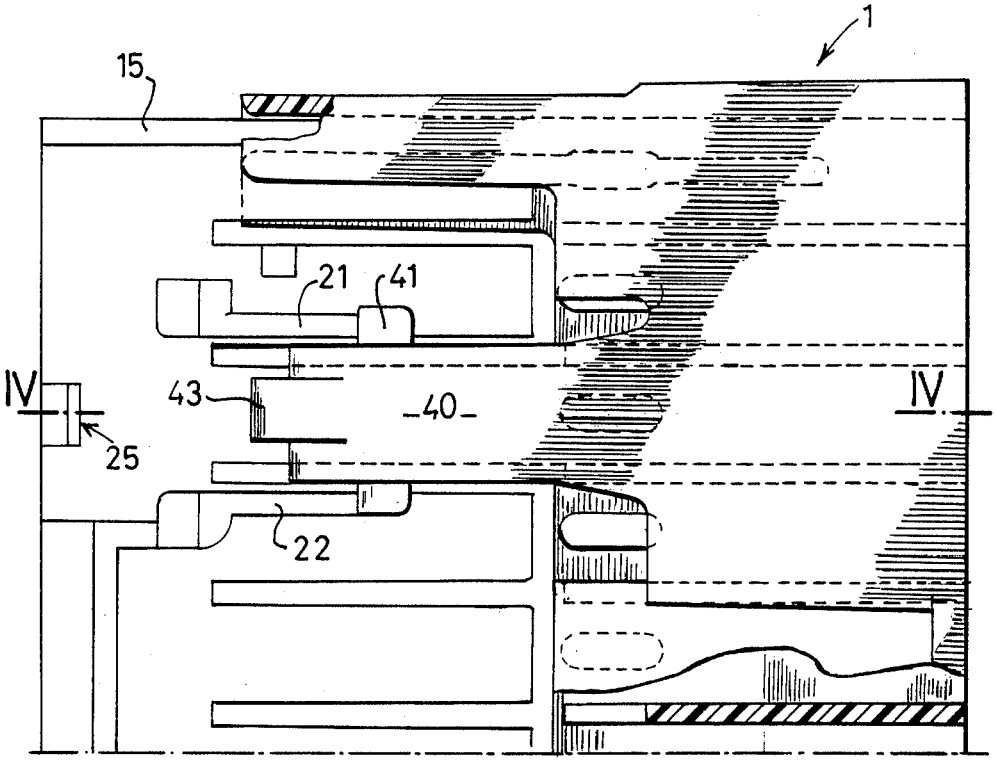
FIG. 5 is a plan view of a connector according to the present invention showing the beginning of insertion of the first and second parts of the insulating box.
Figure 6:
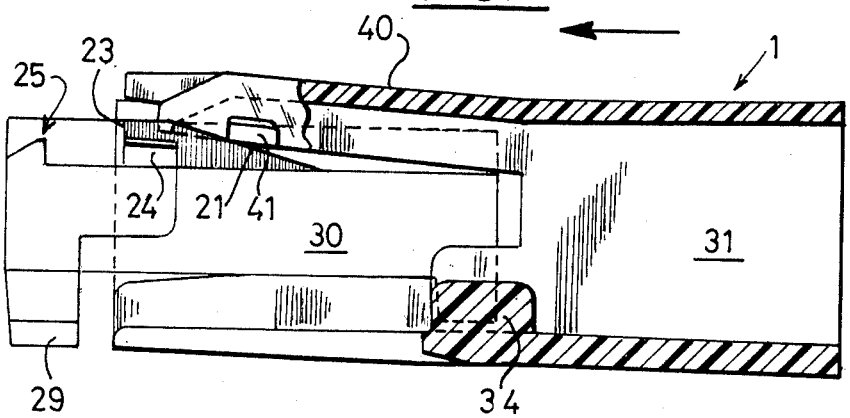
FIG. 6 is a sectional view along line VI—VI of FIG. 7.
Figure 7:
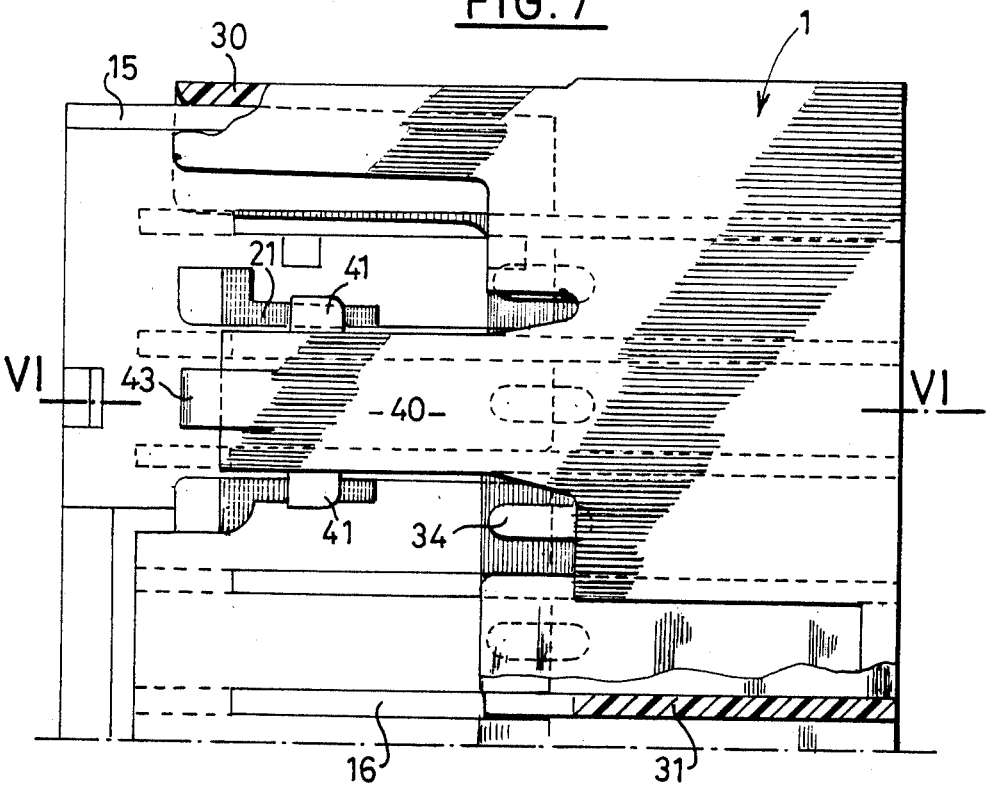
FIG. 7 is a plan view showing the first and second parts of the insulating box at a subsequent stage of the assembly operation.
Figure 8:
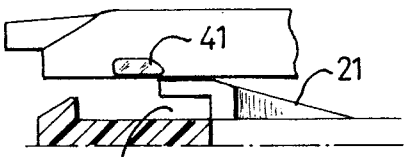
FIG. 8 is a detailed sectional view showing the position of a locking tongue immediately prior to the first preliminary locking phase or position.
Figure 9:
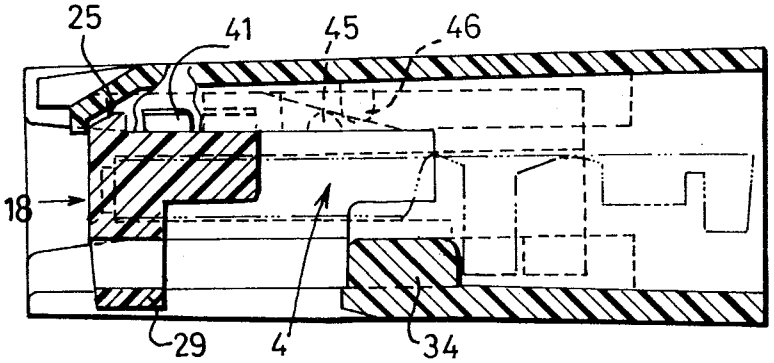
FIG. 9 is a sectional view showing the insulating box in a first preliminary locking position.

During assembly, first part 3 is introduced or inserted into second part 2 with slides 15 being guided in guide bars 30, as shown in FIGS. 2 and 3. First part 3 slides in relation to second part 2 until counter-boss 46 comes to rest against second boss 45. In the course of this movement, side lugs 41 of tongues 40 cooperate with or slidably engage ramp pairs 21 and 22 and locking tongues 40 bend elastically. As seen in FIG. 8, when lugs 41 have moved near steep side 23 of ramp 21 or 22, the free end of locking tongue 40 aligns with inclined part 26 of thrust bearing 25 such that when lugs 41 disengage from ramps 21 and 22, hollow part 42 of locking tongue or clamp 40 fits over thrust bearing 25, as shown in FIG. 9. In this preliminary locking position, second bosses 45 and counter-bosses 46 rest tightly against one another thereby preventing the unhindered displacement of parts 2 and 3 in the direction "f" as seen in FIG. 11, and locking tongues 40 rest against thrust bearing 25.

Electrical connectors according to the present invention can thus be delivered in a state in which clamping devices 7 and 8 are fully protected or shielded fom damage by upper and lower walls 32 and 33 of second housing part 2, as shown in FIG. 9. Furthermore, because the contact elements are mounted in the housing or box 1 during the actual manufacturing stage, the risk of damage to their locking means, i.e., in the present instance, tongues 6, is eliminated.

Figure 11:
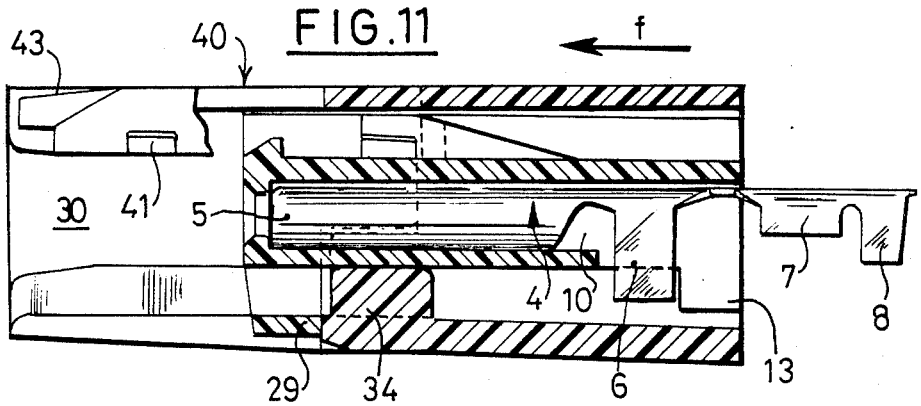
FIG. 11 is a sectional view along line XI—XI of FIG. 12.
Figure 12:
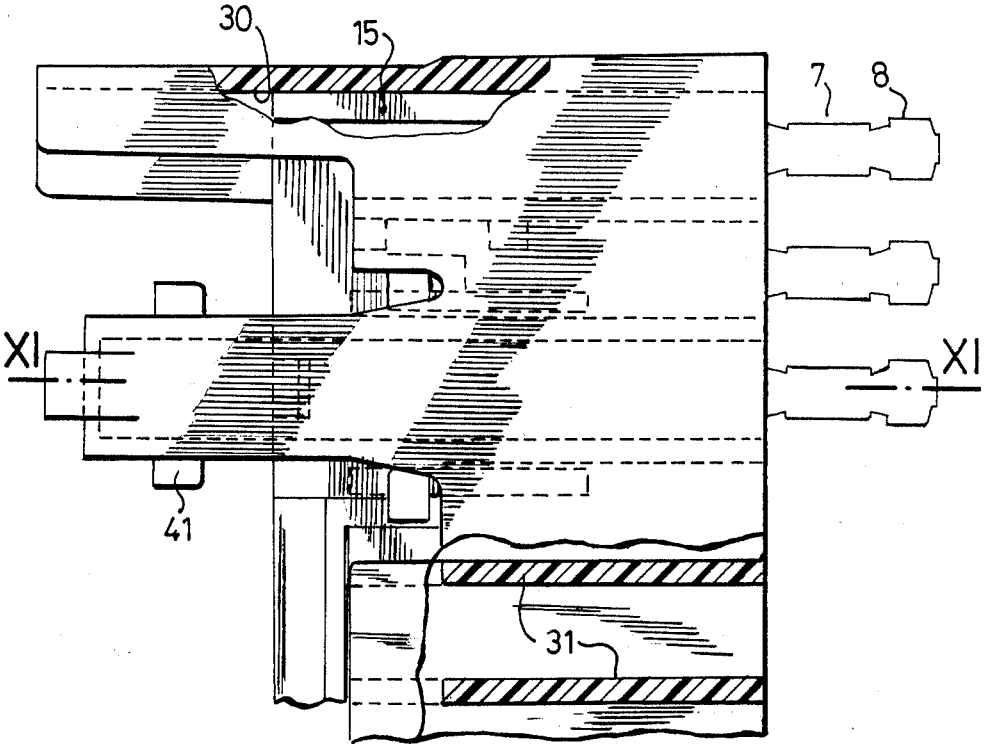
FIG. 12 is a plan view showing the parts of the insulating box in a position in which the parts to be fitted together can be released.

When the connector is to be mounted and contact elements 4 are to be connected to electrical conductors, clamping devices 7 and 8 must be released from second part 2, i.e., clamps 7 and 8 must be moved out from between walls 32 and 33 so that they project out of second housing part 2 as shown in FIG. 11. To carry out this operation, second part 2 is slid in relation to first part 3, in a first direction shown by arrow f in FIG. 11, until stop bar 29 comes to rest against the corresponding edge of lower wall 33. Second bosses 45 and counter-bosses 46 are comparatively low relative to the length of tongues 40 and slits 47 give upper wall 32 a certan flexibility so that counter-bosses 46 can pass above second bosses 45. Therefore, because, in this position, clamps 7 and 8 are situated outside box 1, an electrical conductor can be readily connected to each contact element 4. In the embodiment described, each contact element 4 includes clamp members 7 and 8; this is the most common type of contact system. However, it would be equally feasible, for example, to weld the electrical conductors directly onto simple extensions of contact elements 4 or even to provide alternative conventional means for connecting the contact element to the electrical conductors.

Figure 13:
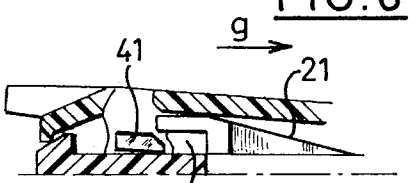
FIG. 13 is a detailed sectional view showing the locking tongue in an intermediate position, prior to the locking operation.
Figure 14:
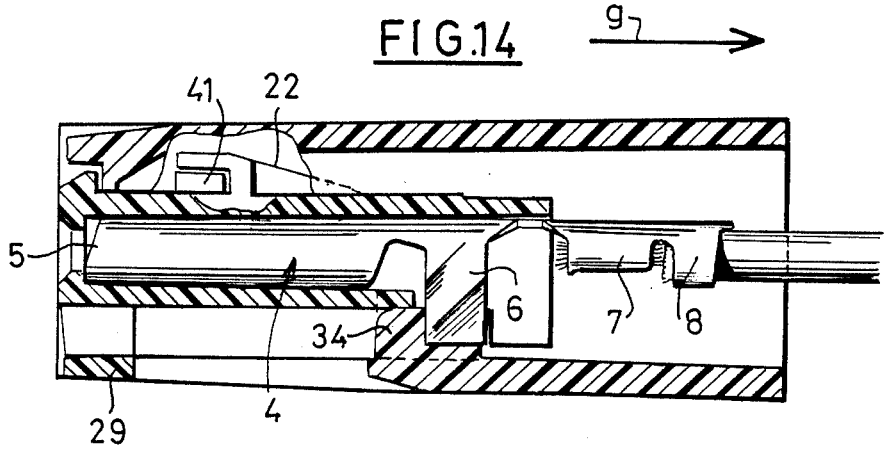
FIG. 14 is a section along line XIV—XIV of FIG. 15.
Figure 15:
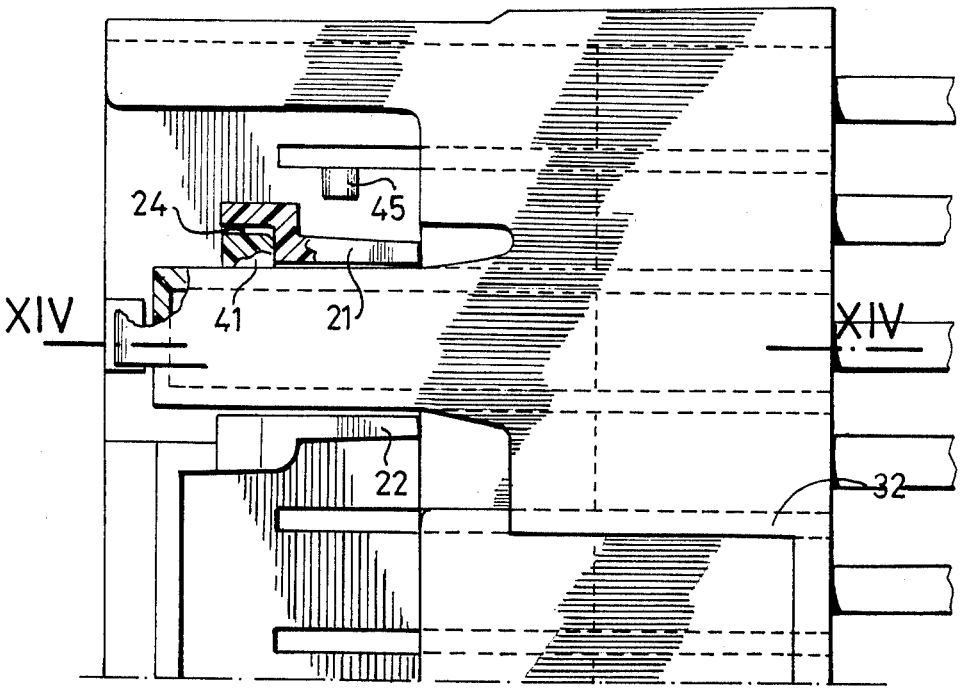
FIG. 15 is a plan view showing the first and second parts of the insulating box locked together.

When all contact elements 4 have been suitably connected to the electrical conductors, first part 3 is slid in relation to second part 2 in the direction shown by arrow g in FIGS. 13 and 14. This direction is opposite to that of arrow f shown in FIG. 11. During this movement, counter-bosses 46 clear second bosses 45 and the free ends of locking tongues 40 slide over inclined parts 26 of thrust bearings 25. It should be noted that thrust bearings 25 are comparatively small relative to the length of tongues 40, so that the elastic deformation undergone by tongues 40 is very slight and lugs 41 can thus enter notches 24 without difficulty. To facilitate this engagement of lugs 41, if necessary, they may be made thinner at the corresponding ends which must first penetrate notches 24, or, alternatively, notches 24 may be widened.

Figure 16:
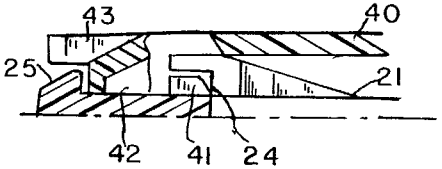
FIG. 16 is a detailed sectional view showing the locking tongue in its final locking position.

When the free end of locking tongue 40 has cleared thrust bearing 25, it drops down steep vertical surface 27 of thrust bearing 25 which acts as a ramp and comes to rest against upper wall 19 of first housing part 3, while lugs 41 enter notches 24 as far as they can go as seen in FIG. 16. In this position, clamps 7 and 8 are likewise protected and insulated by the end of a second part 2, i.e., by upper and lower walls 32 and 33 of second housing part 2, and are separated, from one contact element 4 to another, by partitions 31; also, first and second parts 2 and 3 of insulating box or housing 1, are securely locked together, at the rear, by lugs 41 which have completely entered notches 24 and, at the front, due to the front part of tongue 40, which has returned elastically against surface 19 and which rests against vertical surface 27 of thrust bearing 25 which acts as a ramp.

Figure 10:
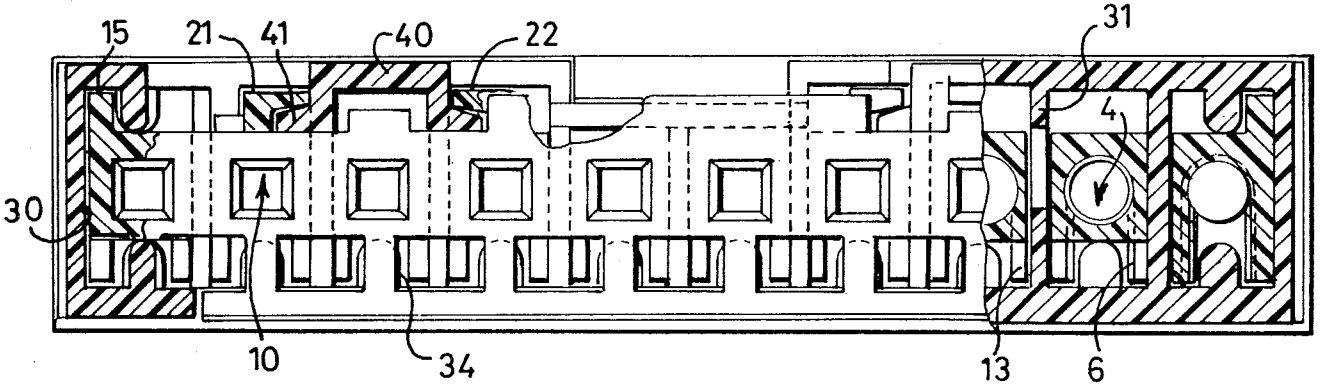
FIG. 10 is a front elevational view of the surface of the insulating box, with parts removed to show the interior thereof.

As shown in FIG. 14 and the broken-away part of FIG. 10, when first and second housing parts 2 and 3 occupy the third final locking position, first bosses 34 come to rest opposite apertures 12, thus tending to prevent retaining clamps 7 and 8 from clearing edge 14 of wings 13.

Release claw 43 enables locking clamp or tongue 40 to be released so that insulating box 1, if necessary, can be returned manually to the first preliminary locking position or to the second position in which clamps 7 and 8 are disengaged, i.e., project from second housing part 2.

A connector according to the present invention is particularly well-suited for automated assembly of electrical conductors to associated contact elements, because the contact clamps and the retaining tongues occupy a protected position and cannot suffer damage in the course of the various manipulations which are necessary during assembly.

The connector according to the present invention is constructed for use in conjunction with an additional insulating box or housing having male plugs for engaging contact elements 4 via holes 18 of the front end of first housing part 3. Of course, as noted above, the present invention has been described and illustrated with female contact members, but could equivalently have been described and illustrated with male contact members such that the additional housing would include female plugs.

From the foregoing description, one skilled in the art can easily ascertain the essential characteristics of the present invention, and, without departing from the spirit and scope thereof, can make various changes and modifications of the invention to adapt it to various usages and conditions. Accordingly, the invention is naturally not limited to the embodiment described above and illustrated in the accompanying drawings, and numerous modifications could be made thereto in matters of details without departing from the scope of the invention.

I claim:

1. An electrical connector including an insulating box having a plurality of substantially parallel compartments each adapted to receive a first electrical contact element having a first portion for making electrical contact with a second electrical contact element and a second portion for connection to an electrical conductor, said insulating box comprising:

(a) a first part comprising said plurality of compartments for receiving said first contact elements, said compartments having a length such that said second portion of said first electrical contact element projects out one end of said compartment, wherein said first part further comprises a surface that includes a pair of ramp members each having a steep side that includes a notch, wherein said first part further includes a thrust bearing having a steep side that faces said steep side of said ramp members;

(b) a second part for slidably receiving said first part comprising an elastic locking tongue each side of which includes a lug for slidably engaging said pair of ramp members while said first part and said second part are sliding with respect to each other, said elastic locking tongue further including a recess for fitting over said thrust bearing; and (c) means for securing said first part and said second part with respect to each other in a first preliminary locking position in which said second part shields said second portion of said first contact elements, a second position in which said second portion is unshielded by said second part to enable said second portion to be connected to an electrical conductor, and a third final locking position in which said second portion is shielded by said second part, and wherein said lugs, said steep sides of said pair of ramp members, said thrust bearing and said recess are disposed relative to each other such that when said first and second parts slide relative to one another in a first direction, said lugs disengage from said ramp members and said elastic locking tongue moves by elastic deformation into position over said thrust bearing so that said first and second parts occupy said first preliminary locking position and such that when said first and second parts slide relative to one another in a second direction substantially opposite to said first direction, said elastic locking tongue disengages from said thrust bearing and comes to rest adjacent to said steep side of said thrust bearing, said lugs engage said notches of said ramp members so that said first and second parts occupy said third final locking position.

2. The connector as recited in claim 1 wherein said ramp members are substantially parallel to each other.

3. The connector as recited in claim 1 wherein said first parts comprises two pairs of said ramp members disposed on opposite sides of said first part, and said second part comprises two said elastic locking tongues.

4. The connector as recited in claim 1 wherein said first part further comprises a boss and said second part further comprises a counter-boss, said boss and said counter-boss resting against each other when said first and said counter-boss resting against each other when said first and second parts occupy said first preliminary locking position, said counter-boss being elastically mounted relative to said boss such that said first part and said second part can continue to slide in said first direction to reach said second position.

5. The connector as recited in claim 1 wherein said elastic locking tongue further comprises a release claw that permits said elastic locking tongue to be disengaged from said thrust bearing.

6. The connector as recited in claim 5 wherein said release claw is disposed on a free end of said elastic locking tongue.

7. A method of interconnecting first and second housing parts of an electrical connector, said first housing part including a plurality of compartments for receiving a respective plurality of first contact elements each having a first portion for making electrical contact with a second electrical contact element and a second portion for connection to an electrical conductor, said compartments having a length such that said second portion of said first electrical contact elements projects out one end of said compartments, said method comprising:

(a) connecting said first and second housing parts relative to each other in a first preliminary locking position such that said second housing part shields said second portion of each said first contact element;

(b) subsequently connecting said first and said second housing parts relative to each other in a second position in which said second portion is unshielded by said second housing part such that said second portion can be connected to a said electrical conductor; and (c) subsequently connecting said first and second housing parts relative to each other in a third final locking position in which said second portion is shielded by said second housing part, wherein said first and second housing parts are slidingly connected relative to each other, wherein said first and second housing parts are connected together in said first preliminary locking position by sliding said first and second housing parts in a first direction relative to one another to a position at which a locking tongue disposed on said second housing part and having a recess on one end is disposed such that said recess fits over a thrust bearing mounted on said first housing part, wherein while said first and second housing parts are being slid in said first direction relative to one another, said locking tongue is lifted elastically relative to said first housing part such that said recess is lifted over said thrust bearing, wherein said locking tongue is lifted by a ramp member which engages a lug disposed on said locking tongue such that when said lug is slid to an edge of said ramp member, said lifting action ends, said locking tongue descends and said recess fits over said thrust bearing, wherein said first and second housing parts are connected relative to each other in said second position by engaging said first and second housing parts from said preliminary locking position whereby said first and second housing parts can be moved relative to one another such that a said second portion is unshielded by said second housing part, wherein said first and second housing parts are disengaged by interaction between a boss disposed on said first housing part and a counter-boss disposed on said second housing part.

8. A method of interconnecting first and second housing parts of an electrical connector, said first housing part including a plurality of compartments for receiving a respective plurality of first contact elements each having a first portion for making electrical contact with a second electrical contact element and a second portion for connection to an electrical conductor, said compartments having a length such that said second portion of said first electrical contact elements projects out one end of said compartments, said method comprising:

(a) connecting said first and second housing parts relative to each other in a first preliminary locking position such that said second housing part shields said second portion of each said first contact element;

(b) subsequently connecting said first and said second housing parts relative to each other in a second position in which said second portion is unshielded by said second housing part such that said second portion can be connected to a said electrical conductor; and (c) subsequently connecting said first and second housing parts relative to each other in a third final locking position in which said second portion is shielded by said second housing part, wherein said first and second housing parts are slidingly connected relative to each other, wherein said first and second housing parts are connected together in said first preliminary locking position by sliding said first and second housing parts in a first direction relative to one another to a position at which a locking tongue disposed on said second housing part and having a recess on one end is disposed such that said recess fits over a thrust bearing mounted on said first housing part, wherein while said first and second housing parts are being slid in said first direction relative to one another, said locking tongue is lifted elastically relative to said first housing part such that said recess is lifted over said thrust bearing, wherein said locking tongue is lifted by a ramp member which engages a lug disposed on said locking tongue such that when said lug is slid to an edge of said ramp member, said lifting action ends, said locking tongue descends and said recess fits over said thrust bearing, wherein said first and second housing parts are connected relative to each other in said second position by disengaging said first and second housing parts from said preliminary locking position whereby said first and second housing parts can be moved relative to one another such that a said second portion is unshielded by said second housing part, wherein said first and second housing parts are disengaged by interaction between a boss disposed on said second housing part and a counter-boss disposed on said first housing part.

9. A method of interconnecting first and second housing parts of an electrical connector, said first housing part including a plurality of compartments for receiving a respective plurality of first contact elements each having a first portion for making electrical contact with a second electrical contact element and a second portion for connection to an electrical conductor, said compartments having a length such that said second portion of said first electrical contact elements projects out one end of said compartments, said method comprising:

(a) connecting said first and second housing parts relative to each other in a first preliminary locking position such that said second housing part shields said second portion of each said first contact element;

(b) subsequently connecting said first and said second housing parts relative to each other in a second position in which said second portion is unshielded by said second housing part such that said second portion can be connected to a said electrical conductor; and (c) subsequently connecting said first and second housing parts relative to each other in a third final locking position in which said second portion is shielded by said second housing part, wherein said first and second housing parts are slidingly connected relative to each other, wherein said first and second housing parts are connected together in said first preliminary locking position by sliding said first and second housing parts in a first direction relative to one another to a position at which a locking tongue disposed on said second housing part and having a recess on one end is disposed such that said recess fits over a thrust bearing mounted on said first housing part, wherein while said first and second housing parts are being slid in said first direction relative to one another, said locking tongue is lifted elastically relative to said first housing part such that said recess is lifted over said thrust bearing, wherein said locking tongue is lifted by a ramp member which engages a lug disposed on said locking tongue such that when said lug is slid to an edge of said ramp member, said lifting action ends, said locking tongue descends and said recess fits over said thrust bearing, wherein said first and second housing parts are connected relative to each other in said second position by disengaging said first and second housing parts from said preliminary locking position whereby said first and second housing parts can be moved relative to one another such that a said second portion is unshielded by said second housing part, wherein said first and second housing parts are connected together in said third final locking position by sliding said first and second housing parts relative to one another in a second direction opposite to said first direction such that said recess in said locking tongue disengages said thrust bearing and comes to rest adjacent to a steep side of said thrust bearing and said lug engages a notch formed in said ramp member.

* * * * *